US008291829B1

(12) United States Patent
Dunlavy et al.

(10) Patent No.: US 8,291,829 B1
(45) Date of Patent: Oct. 23, 2012

(54) MOTORIZED TRANSPORT CART AND ASSOCIATED PART TRANSPORT SYSTEM AND METHOD

(75) Inventors: Richard Dunlavy, Cable, OH (US); Steve Oppy, Bellefontaine, OH (US); David Bonaventura, Hilliard, OH (US); Anthony Wilkins, Cable, OH (US)

(73) Assignee: Honda Motor Co., Ltd., Tokyo (JP)

( * ) Notice: Subject to any disclaimer, the term of this patent is extended or adjusted under 35 U.S.C. 154(b) by 262 days.

(21) Appl. No.: 12/750,343

(22) Filed: Mar. 30, 2010

(51) Int. Cl.
*E01B 25/28* (2006.01)

(52) U.S. Cl. ..... 104/288; 104/120; 105/145

(58) Field of Classification Search ..... 104/118–120, 104/242, 287, 288, 295, 299; 105/141, 145
See application file for complete search history.

(56) References Cited

U.S. PATENT DOCUMENTS

| | | | | |
|---|---|---|---|---|
| 2,853,956 | A | 9/1958 | Wenner-Gren et al. | |
| 3,727,560 | A | 4/1973 | Blemly et al. | |
| 3,783,795 | A * | 1/1974 | Helmer | 105/61 |
| 3,807,312 | A | 4/1974 | Flodell | |
| 4,090,452 | A | 5/1978 | Segar | |
| 4,941,407 | A | 7/1990 | Pigott | |
| 5,450,796 | A * | 9/1995 | Sakagami | 104/89 |
| 5,511,487 | A * | 4/1996 | Sakagami et al. | 104/252 |
| 6,138,575 | A * | 10/2000 | Geng | 104/140 |
| 6,418,855 | B1 | 7/2002 | Fischer | |
| 7,597,521 | B2 * | 10/2009 | Wastel | 414/240 |

* cited by examiner

*Primary Examiner* — Mark Le
*Assistant Examiner* — Zachary Kuhfuss
(74) *Attorney, Agent, or Firm* — Standley Law Group LLP

(57) ABSTRACT

A motorized transport cart and a system and method employing one or more of such carts. The carts may be used to transport assembly parts or other items of interest within a desired area. Each cart includes its own drive system, including a drive motor and drive wheel assembly that propels the cart along a guide rail assembly affixed to the transport area floor. Power for the drive motor is transferred from a conductor rail of the guide rail assembly through a contactor assembly of the cart. The drive system includes a sensor that is used to signal a drive controller of the cart drive system to de-energize the drive motor and halt motion of the cart when a trailing cart gets within a certain distance of a leading cart in a row of carts. Carts may be automatically arranged into properly spaced rows with little user interaction, and the carts of a given row will automatically move forward when a lead cart of the row is removed.

19 Claims, 9 Drawing Sheets

MOTORIZED TRANSPORT CART AND ASSOCIATED PART TRANSPORT SYSTEM AND METHOD

TECHNICAL FIELD

The present invention is directed to a motorized cart for transporting items of interest along a guided path, as well as a transport system and method that employs a number of such carts.

BACKGROUND

The transport of items of interest between separated locations may be a required task in a number of commercial, industrial or other settings. For example, the need to transport parts or other required items between various areas of a manufacturing facility is well understood.

A particularly illustrative but non-limiting example of such a setting is an automobile manufacturing plant, where a multitude of different parts are required to assemble a complete vehicle. Generally, a manufacturing plant is divided into a number of different departments where one or more processes involving one or more different parts or subassemblies of a vehicle being assembled are performed. As would be well understood by one of skill in the art, such a manufacturing operation will normally require that vehicle parts or subassemblies be transported from one location to another within a given department, as well as between a location in one department and a location in another department. Whether this part or subassembly transport is of an inter-department or intra-department nature, the involved parts and/or subassemblies are typically located on/in rolling containers, racks or other temporary storage and transport devices (generally referred to collectively hereafter as "carts").

A number of automated devices and systems have been developed and employed for transporting items of interest across the vast area often occupied by many manufacturing facilities. For example, in automobile manufacturing plants, various overhead and/or in-floor conveyor systems may transport individual components, subassemblies, or entire vehicles through a plurality of manufacturing and assembly operations. In such facilities, forklifts, tow motors and automated guided vehicles (AGV's) may also be employed for component and/or subassembly transport—frequently carrying or towing the components and/or subassemblies on specially designed carts.

While long-distance transport of such items of interest is often well thought out and executed, the movement or transport of parts or subassemblies within a more confined area, such as within a predefined area of a given department, is not always as well-automated. Rather, short distance movement of such items is often wholly lacking in automation—relying instead on physical manpower to transport the items from one location to another.

While such a transport method may not be problematic in many situations, one skilled in the art would readily understand that such is not always the case. For example, a cart provided for temporarily holding items of interest and facilitating the transport thereof may be designed to hold a large number of said items. Alternatively, a provided cart may hold only a few items of interest, but the items of interest may be of considerable weight and/or size. Still yet, the items of interest may be large and/or heavy and an associated cart may be designed to hold a significant number of such items, thereby compounding the problem. Therefore, depending on the physical characteristics of the particular item(s) of interest being transported and the design of the carts provided to transport said items, it can be easily understood that manual movement of such carts when loaded (and even when empty) may be difficult. This difficulty may result from the weight of a loaded (or empty) cart, and/or the overall space occupied by a loaded (or empty) cart.

As one non-limiting example, again consider an automobile manufacturing operation and, more particularly a bumper fascia manufacturing operation. It is well known that bumper fascias can be of considerable size—generally at least as long as the width of an automobile and frequently 12-24 inches in height. Thus, in addition to weighing from several to tens of pounds, such bumper fascias are fairly large and difficult to maneuver. Consequently, carts provided to temporarily store and transport bumper fascias are also typically large. For example, such carts are frequently designed to hold and transport 12 or more bumper fascias at a time.

The difficulties with manually moving such a cart from one location to another, even over relatively short distances, should be obvious (particularly when loaded). In addition to the force required to set and maintain a large cart in motion, there is also the difficulty of accurately maneuvering such a cart between and around other carts and the various equipment and workers commonly scattered about the transport area. These difficulties are compounded when it is also considered that such a manufacturing operation may commonly employ a large number of carts, which must be frequently moved. For example, a bumper fascia manufacturing operation may use in excess of 100 carts and may produce more than 1,000 fascias per day.

Therefore, it should also be obvious that it would be advantageous to employ a system and method wherein at least a portion of such a transport function is automated. A cart, system and method of the present invention provides for such automation.

SUMMARY OF THE GENERAL INVENTIVE CONCEPT

The present invention is directed to a motorized cart that can be used to transport items of interest along a pre-defined path(s) with little or no operator intervention. Further, the present invention is directed to a system and method for transporting items of interest using a plurality of such carts.

A cart of the present invention may take various forms depending, largely on the particular items of interest to be transported thereby. Generally, however, a cart of the present invention will have a framework and/or side walls, a structure for temporarily holding one or more items of interest, and a plurality of wheels for allowing the cart to roll upon the floor or another base surface (the cart supporting surface generally referred to hereafter as the "floor") of the facility in which the cart is located.

A cart of the present invention is provided with a drive system for moving the cart without the need for human force. The drive system of a cart of the present invention typically includes a drive motor, a drive controller, a drive wheel assembly having a drive wheel and an opposing guide (idler) wheel, and a contactor for transferring electrical energy from a floor-mounted power bus to the drive motor. The drive wheel is rotationally driven by the drive motor. Depending on the size of the cart, a guide wheel assembly may also be provided. The guide wheel assembly may include a pair of opposing guide wheels that are separated by some distance from the drive wheel assembly in the direction of cart travel. At least some of the drive system components may be attached to a common mounting base.

A cart of the present invention is designed to travel along a predetermined path defined by a guide rail assembly affixed to the floor in the area about which the cart is to be moved. The guide rail portion extends upward from the floor by a distance sufficient to allow its engagement between the drive wheel and idler wheel of the cart drive wheel assembly. The drive wheel assembly functions as a friction drive to move the cart along the guide rail.

Also associated with the guide rail assembly is a conductor rail that receives electrical energy from an associated power supply. The conductor rail typically extends substantially the length of the guide rail. The conductor rail is designed and located to engage the contactor of the cart drive system as the cart travels along the guide rail. As a result, electrical energy is supplied from the power supply to the cart drive motor via interaction of the conductor rail and the contactor.

A cart of the present invention employs a drive controller to control the movement of carts of the present invention along a guide rail. The drive controller allows a number of carts to be moved along a single guide rail so as to form a row of carts of some number. The drive controller may include at least a motor control circuit board and a photo-detector or similar sensor.

Each cart is equipped with a sensor along its leading edge and a blocking element along its trailing edge. When a new cart is introduced to an existing row of parked carts, the signal from the sensor on the leading edge of the moving cart becomes blocked by the blocking element at the trailing edge of the rearmost stopped cart when the moving cart gets within a predetermined distance of the stopped cart. This blockage of the sensor signal is used to deactivate the drive motor of the moving cart, which halts movement of the moving cart before it can hit the stopped cart. When the lead cart in a row is removed, all the remaining carts in the row automatically move forward by approximately one cart length.

Thus, the system and method of the present invention allows for automatic accumulation of carts of the present invention into rows. The system and method of the present invention also allows rows of carts of the present invention to automatically transfer forward through staged rows without any human intervention (other than periodically removing the lead cart). A remote control box may be provided on each cart to permit manual stopping of a cart and/or to reverse the direction of cart travel along a guide rail.

BRIEF DESCRIPTION OF THE DRAWINGS

In addition to the features mentioned above, other aspects of the present invention will be readily apparent from the following descriptions of the drawings and exemplary embodiments, wherein like reference numerals across the several views refer to identical or equivalent features, and wherein.

DETAILED DESCRIPTION OF EXEMPLARY EMBODIMENT(S)

Figure 1:
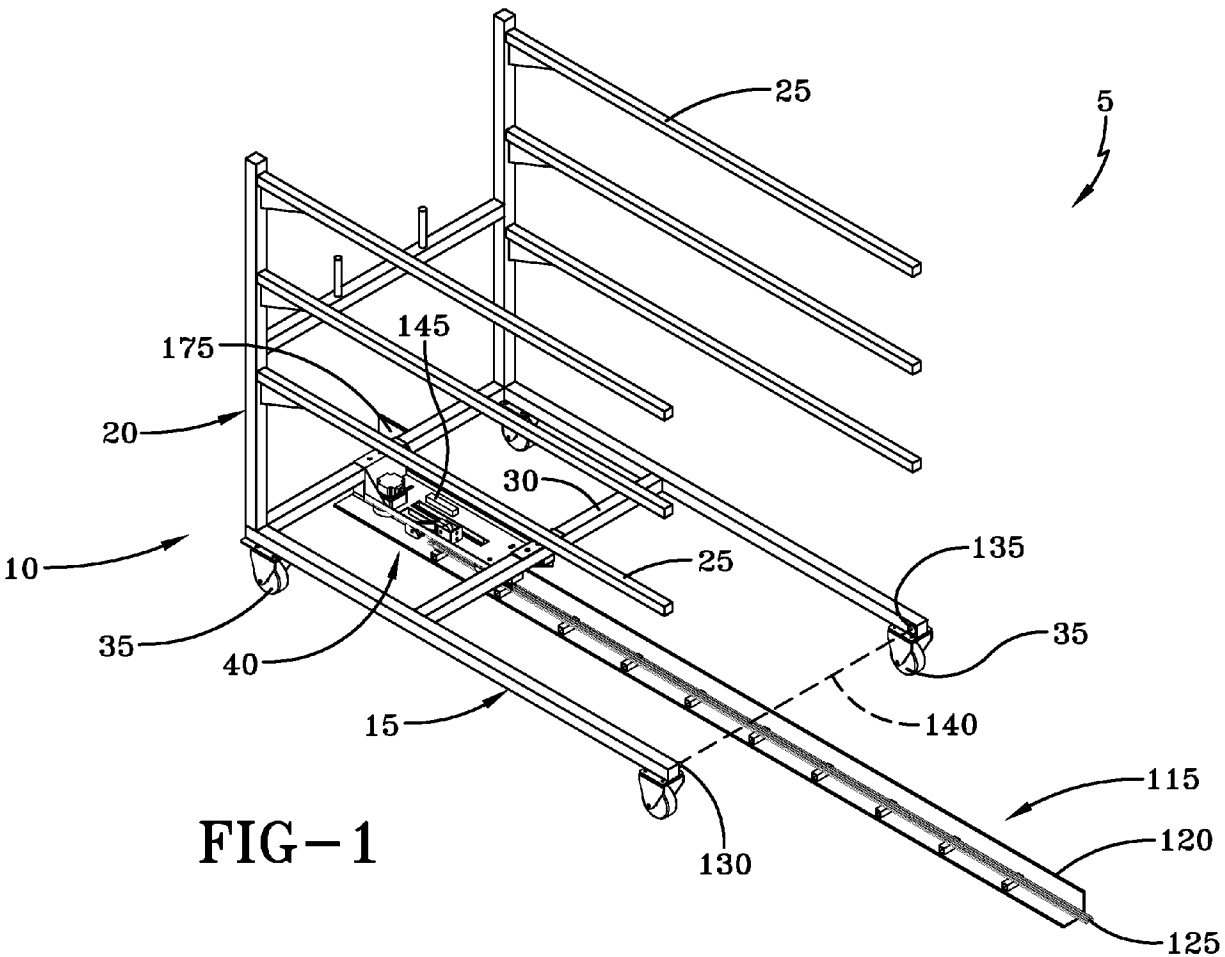
FIG. 1 is a front perspective view of an exemplary motorized cart of the present invention just prior to powered engagement with a guide rail assembly of a system of the present invention.
Figure 2:
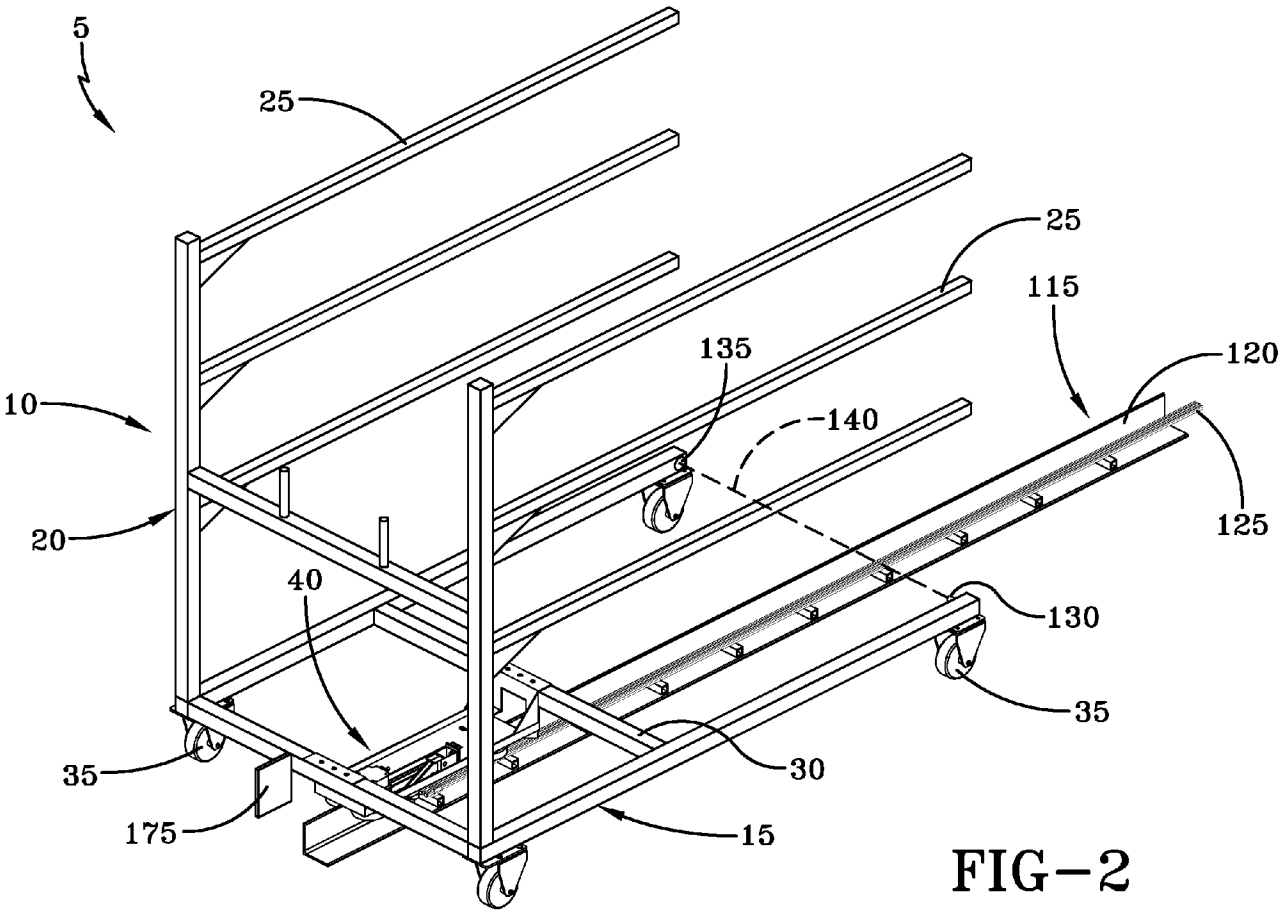
FIG. 2 is a rear perspective view of the exemplary motorized cart of FIG. 1 after engagement with a guide rail assembly of a system of the present invention.

One exemplary motorized cart 5 of the present invention is depicted in FIGS. 1-2. This particular cart 5 is an automobile bumper fascia transport cart, however, it would be apparent to one of skill in the art that the present invention is not limited to a cart used for any particular purpose.

The exemplary cart 5 includes a framework 10 which, in this case, includes a base frame 15, an upright support frame 20, and a plurality of substantially horizontal bumper fascia support arms 25 extending from the upright support frame. The base frame 15 includes a cross-brace 30 that strengthens the base frame and maintains the spacing of its members.

Wheels 35 are affixed to a bottom side of the base frame 15, such that the cart 5 rolls on the wheels. In this case, there are four wheels 35, but other carts embodiments of the present invention may have an alternative number of wheels as long as the cart is rendered sufficiently stable. As used herein, the term "wheels" includes common wheels, as well as casters, rollers, tracks and any other devices that permit a cart of the present invention to be rolled across the floor.

Figure 3:
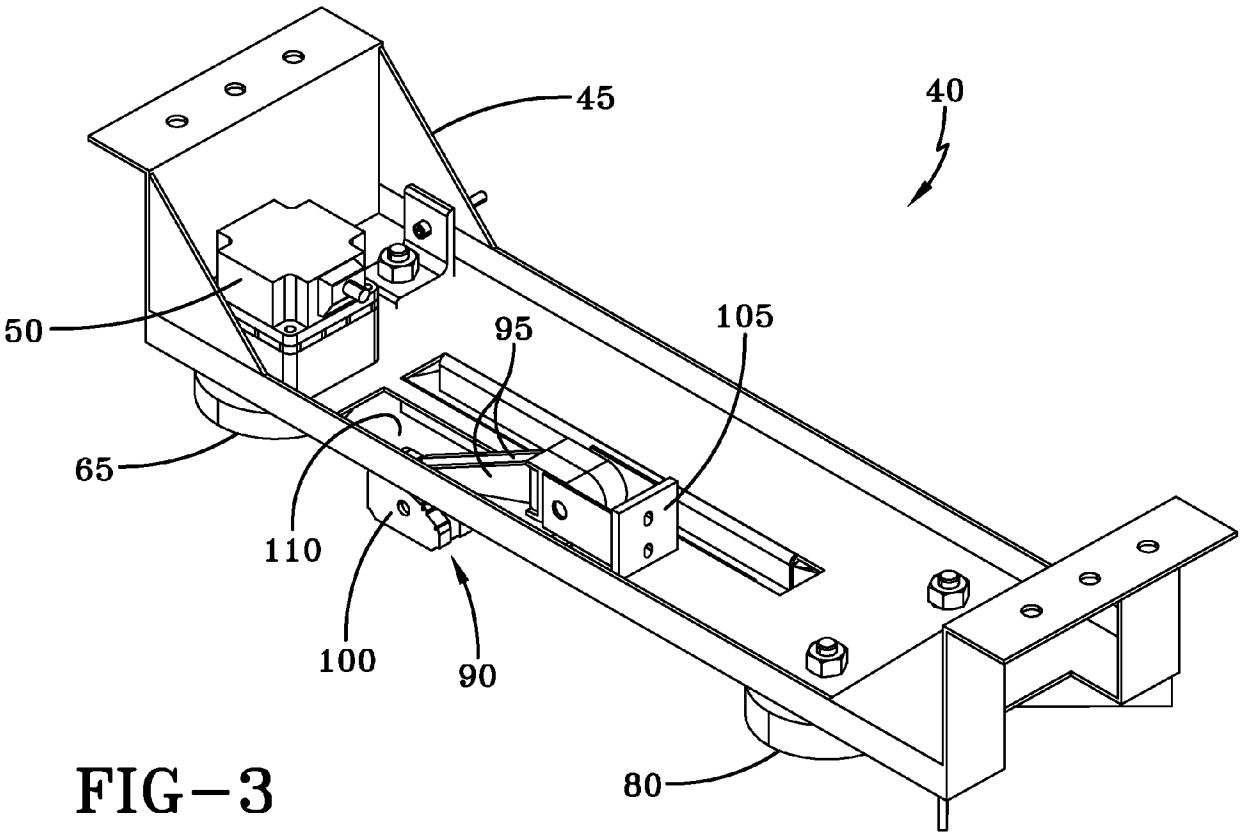
FIG. 3 is an enlarged top perspective view of an exemplary drive system that may be use by a motorized cart of the present invention.
Figure 4:
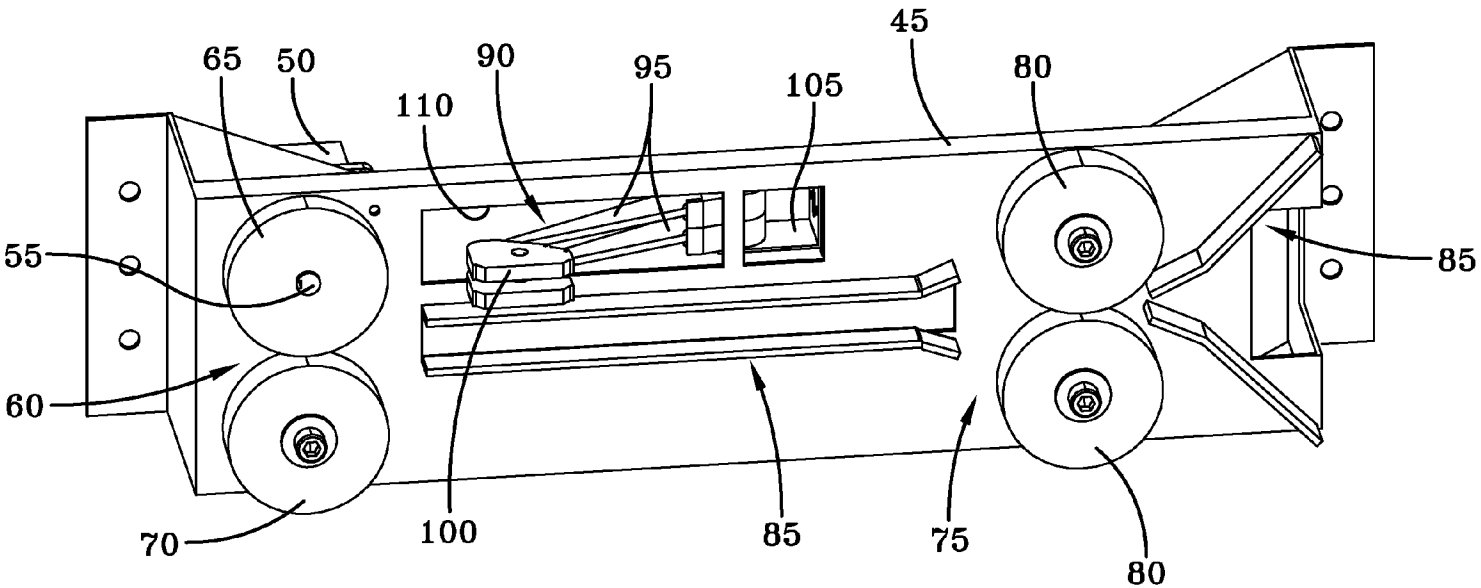
FIG. 4 is an enlarged bottom perspective view of the exemplary drive system of FIG. 2.

A drive system 40 is associated with the cart 5 for driving the cart along an intended path. The exemplary drive system 40 of FIGS. 1-2 can be observed more clearly in FIGS. 3-4. As shown, this exemplary drive system includes a common mounting base 45, a drive motor 50, a drive wheel assembly 60, a guide wheel assembly 75, a cart guide 85, a contactor assembly 90, and a drive controller 145 (see FIG. 1 and FIG. 6).

The drive motor 50 is affixed to the mounting base 45, with the motor drive shaft 55 extending substantially vertically downward through an aperture (not shown) in the base. In this example, the drive motor is a gear motor, but other motor types may also be used, including separate motor/gear reducer assemblies. The drive wheel 65 of the drive wheel assembly 60 is mounted to the drive shaft 55.

The drive wheel assembly 60 also includes an idler wheel 70 that is mounted beneath the mounting base 45 and opposes the drive wheel 65. The drive wheel 65 and idler wheel 70 are arranged such that there is a small gap therebetween. As described in more detail below, the gap between the drive wheel 65 and idler wheel 70 of the drive wheel assembly 60 is preferably slightly less than the thickness of the guide rail 120 along which the cart 5 travels.

The drive system 40 of this particular cart 5 also includes an optional guide wheel assembly 75 that is comprised of a pair of opposed idler wheels 80. As with the idler wheel 70 of the drive wheel assembly 60, the idler wheels 80 of the guide wheel assembly 75 are mounted beneath the mounting base 45. The drive wheel assembly 60 and the guide wheel assembly 75 are preferably separated by some distance along the forward/reverse travel direction of the cart 5.

Preferably, but not essentially, cart guides 85 are provided along a bottom surface of the mounting base 45 to help direct the cart 5 onto the guide rail 120 over which it will travel. When present, the design of the cart guide(s) may vary. In this particular embodiment, the cart guides 85 include a forward portion for facilitating initial alignment and engagement of the guide wheel assembly 75 with a guide rail 120, and an intermediate portion for maintaining cart-to-guide rail alignment and for facilitating alignment and engagement of the drive wheel assembly 60 with the guide rail.

The drive system 40 also includes a contactor assembly 90. This exemplary contactor assembly 90 includes a pair of contactor arms 95, each of which includes a conductor element 100 at its distal end. The proximal ends of the contactor arms 95 are pivotally connected to a bracket 105 that is affixed to or part of the mounting base 45. This arrangement allows the contactor arms 95 and associated conductor elements 100 to hang downward through an opening 110 in the mounting base 45. In a normal position of the contactor assembly 90, at least the conductor elements 100 thereof are suspended below the bottom face of the mounting base 45.

Figure 6:
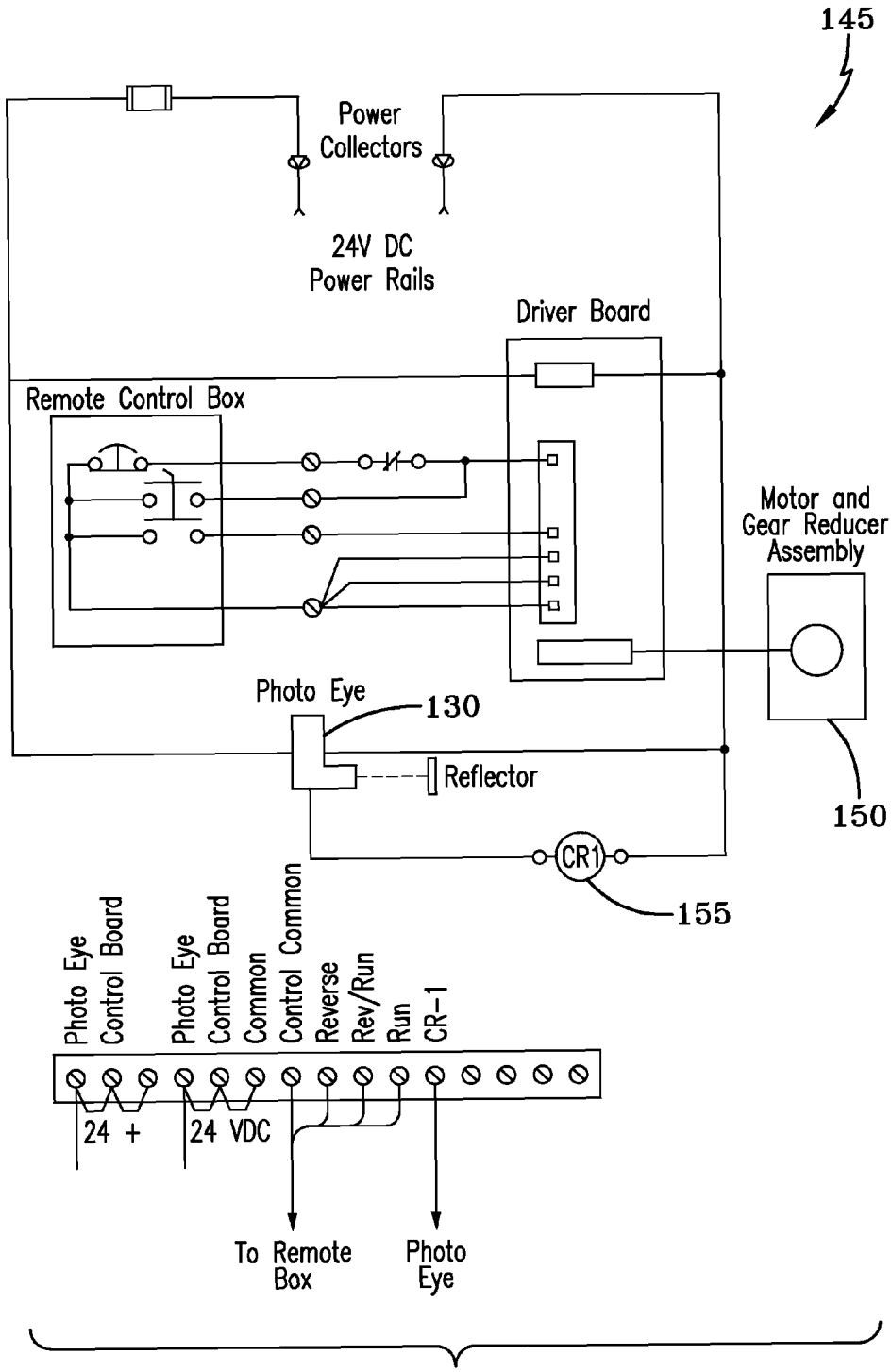
FIG. 6 is an exemplary wiring layout for a cart of the present invention.

As best observed in FIGS. 1 and 6, a drive controller 145 also forms a part of the drive system 40. The drive controller preferably includes a motor control circuit board 150 and may include a control relay 155 that can be used in conjunction with a sensor 130 to control movement of a cart of the present invention (see below).

Referring back to FIGS. 1-2, it can be seen that the mounting base 45 is secured to the base frame 15 of the cart 5. More particularly, in this example, the mounting base 45 is secured between a rear member of the base frame 15 and the cross-member 30. Obviously, however, the particular mounting technique employed may vary considerably depending on the construction of a given cart. In any event, the mounting base 45 is oriented such that the drive wheel 65 and idler wheel 70 of the drive wheel assembly 60 and the idler wheels 80 of the guide wheel assembly 75 reside substantially parallel to the floor (i.e., their central axes are substantially perpendicular to the floor). Consequently, the wheels of the drive wheel assembly 60 and guide wheel assembly 75 will also rotate substantially parallel to the floor. In contrast, the contactor arms 95 of the contactor assembly 90 are rotatable in a plane that is substantially perpendicular to the floor and substantially parallel to the forward/reverse direction of cart travel.

Carts of the present invention are intended to travel along and be guided by a guide rail assembly mounted to the floor. Such a guide rail assembly 115 is depicted in FIGS. 1-2. The guide rail assembly 115 includes a guide rail 120 portion and a conductor rail 125 portion.

The guide rail 120 portion of the guide rail assembly 115 may be constructed of metal angle or another convenient structural shape, etc. In any case, the guide rail 120 includes a vertically oriented rail that extends upward some distance from the floor. More particularly, the vertically oriented rail portion of the guide rail 120 extends upward a distance that allows for its engagement between the respective wheel pairs of the drive wheel assembly 60 and guide wheel assembly 75 as the cart 5 travels overhead. This distance may vary depending on the height of the cart wheels 35, etc.

The gap between the drive wheel 65 and idler wheel 70 of the drive wheel assembly 60 is preferably selected to be slightly less than the thickness of the vertically oriented rail portion of the guide rail 120. At least the drive wheel 65 may be constructed of a slightly compressible material and, even more preferably, a high friction material, to accommodate the guide rail thickness and to grip the guide rail during drive wheel rotation. As such, the drive motor 50, drive wheel assembly 60, and guide rail 120, combine to form a friction drive for propelling the cart 5.

The guide rail assembly 115 also includes a conductor rail 125 that runs substantially parallel to the guide rail 120. The conductor rail 125 is in electrical communication with a source of electrical energy. In this particular case, the conductor rail 125 is connected to a 24 VDC power supply and, therefore, the conductor rail is continuously charged with 24 VDC electrical energy (unless the power supply is disconnected or turned off). The choice of power supply may vary in other embodiments.

A cart of the present invention is also provided with a sensor that facilitates automatic cart movement. In this regard, the exemplary cart 5 shown and described herein is provided with a photo-sensor 130 and associated reflector 135 along its leading edge. It may be possible to employ other sensor types in other embodiments of the present invention. In this particular cart 5, the photo-sensor 130 and reflector 135 are located in the leading end of the two opposed base frame 15 members that extend along the length of cart travel. The sensor arrangement of other embodiments may be otherwise located as long as the sensor arrangement is able to provide the function described below.

As can be best observed in FIGS. 1-2 and 6, the photo-sensor 130 and reflector 135 combine to create a sensing beam 140 across the leading edge of the cart 5. As explained in more detail below, a signal from the photo-sensor 130 can be used with the control relay 155 and motor control circuit board 150 of the drive controller 145 to control automatic movement of a cart of the present invention.

Figure 7:
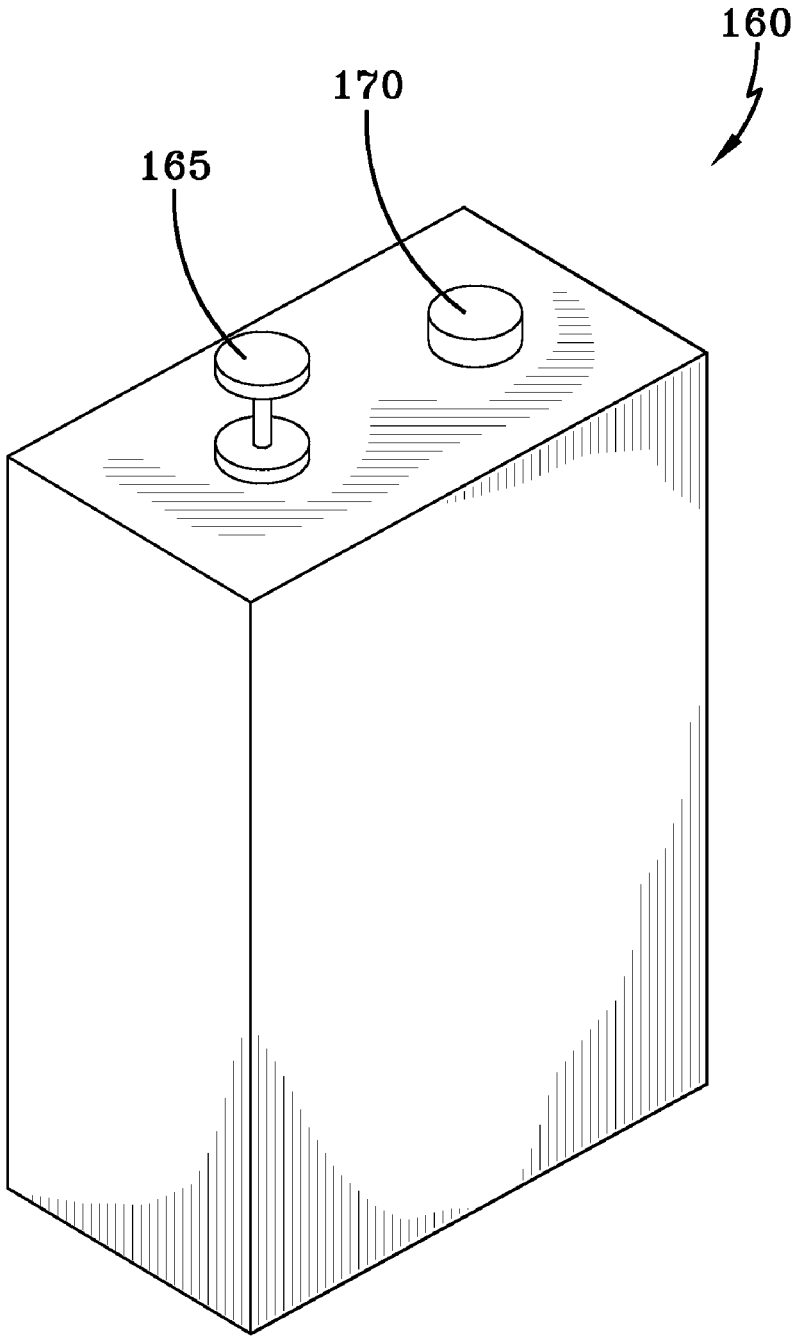
FIG. 7 is an enlarged view of a remote control box that may be installed to a cart of the present invention.

Referring to FIG. 7, a remote control box 160 that may be used to manually control movement of a cart of the present invention may be observed. The remote control box 160 may be mounted to a conveniently accessible area of a cart of the present invention and electrically connected to the cart's drive controller to allow for manual control of cart movement. Control options may vary. In this exemplary remote control box embodiment, the remote control box is provided with a stop button 165 that allows an operator to stop motion of the cart and a reverse button 170 that allows an operator to reverse the direction of cart travel.

Operation of a cart and system of the present invention can be best understood by reference to FIGS. 1-6. First, the guide rail assembly 115 is affixed to the floor of an area of cart travel and arranged to trace a desired cart path. The guide rail assembly 115 is constructed as described above, and its conductor rail 125 is connected to a provided power supply. The cart 5 is subsequently rolled over the guide rail assembly 115, whether manually or with powered assistance, such that the wheels 80 of the guide wheel assembly 75 straddle opposite sides of the vertically oriented rail portion of the guide rail 120. Continued advancement of the cart 5 along the guide rail assembly 115 causes the vertically oriented rail portion of the guide rail 120 to pass through the cart guides 85, thereby ensuring proper alignment of the cart and the guide rail assembly.

As the cart 5 is moved further onto the guide rail assembly 115, the conductor elements 100 of the contactor assembly 90 come into contact with the conductor rail 125 of the guide rail assembly 115. Once this contact occurs, electrical energy from the power supply is transferred to and energizes the drive motor 50 which, in turn, activates the drive wheel assembly 60. Thus, once the cart 5 is pushed sufficiently over the guide rail assembly 115 to bring the vertically oriented rail portion of the guide rail 120 between the drive wheel 65 and idler wheel 70 of the drive wheel assembly 60, the cart will be automatically propelled along the guide rail assembly by its drive system 40.

Motion of the moving cart 5 may be automatically halted by terminating the conductor rail 125 of the guide rail assembly 115 at some point prior to the end of the guide rail 120 portion thereof. The precise point of drive termination will generally coincide with the desired location of cart stoppage. Consequently, the cart 5 will travel along the guide rail assembly 115 as described above until the conductor elements 100 of the contactor assembly 90 lose contact with the conductor rail 125 at the point of conductor rail termination. Power is then removed from the drive controller 145 and drive motor 50, automatically stopping motion of the cart. Preferably, the cart 5 is stopped such that at least the wheels of the drive wheel assembly 60 are still engaged with the guide rail 120. This technique allows a cart to be automatically stopped at the end of a guide rail, whereafter the cart can be removed by manual or powered means.

In an alternative embodiment, it may be possible to employ a blocking element that is located along the path of the guide rail assembly 115 to block the photo beam 140 extending across the leading edge of the moving cart 5 at a point of desired cart stoppage. Such a blocking element may be associated with the guide rail assembly 115 or could be mounted to the floor. It is possible that such a blocking element could also be made to extend and retract if necessary to avoid interference during cart travel.

Figure 5:
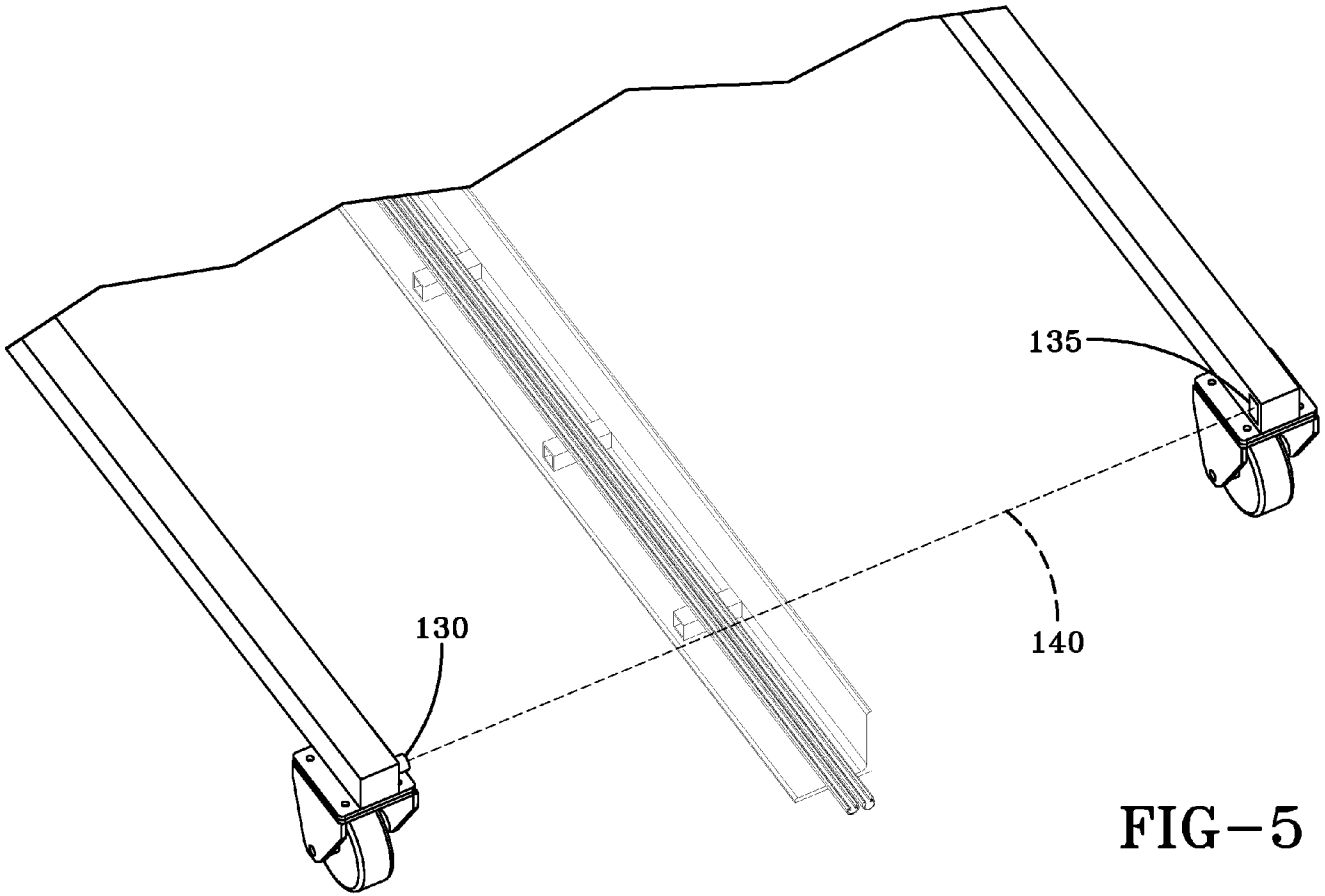
FIG. 5 is an enlarged view of a leading portion of the cart of FIGS. 1-2, depicting in more detail the sensor operation thereof.

Automatic row formation and cart movement within such rows will now be explained in conjunction with FIGS. 5-6 and FIG. 8. As explained above and as shown in FIGS. 1-2 and FIG. 5, each cart 5 is equipped with a photo-sensor 130 and reflector 135 along its leading edge. As shown in FIGS. 1-2, each cart 5 is also provided with a blocking element 175 along its trailing edge.

Figure 8:
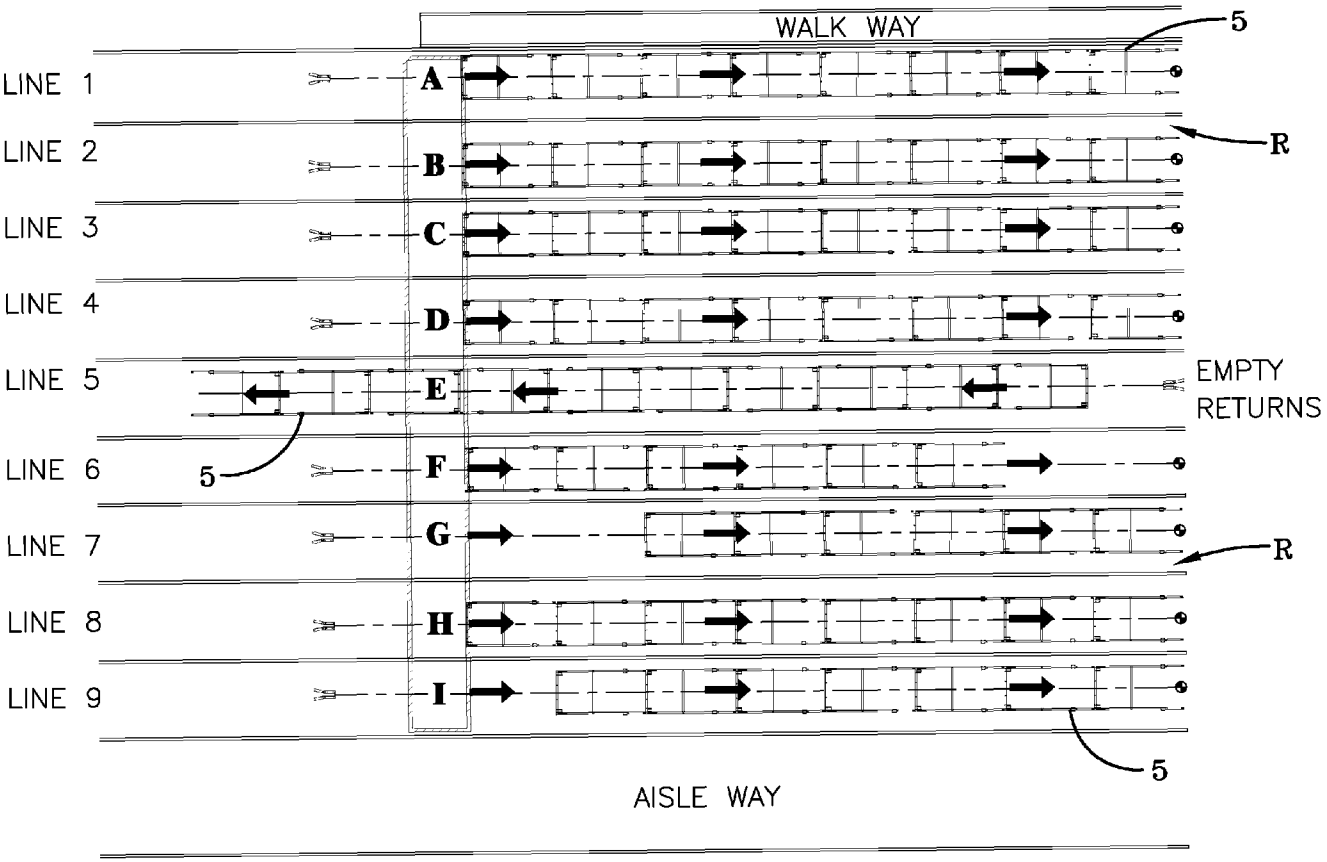
FIG. 8 is a top view depicting a system of the present invention, whereby a plurality of carts are accumulated in a plurality of rows.

When a new cart is introduced to an existing row R of parked carts 5, as illustrated in FIG. 8, the photo beam 140 extending across the leading edge of the moving cart becomes blocked by the blocking element 175 at the trailing edge of the rearmost stopped cart when the moving cart gets within a predetermined distance of the stopped cart. This blockage of the photo beam 140 causes the photo-sensor 130 to signal the control relay 155 and motor control circuit board 150 of the drive controller 145 to de-energize the drive motor 50 of the moving cart, which halts forward motion of the moving cart before it contacts the stopped cart. This allows a properly spaced row of carts to be automatically formed along a given guide rail without operator intervention, and without cart collisions. When the lead cart in a row is removed, the photo beam of the next cart in line becomes unblocked, allowing that cart and all the remaining carts in the row to thereafter automatically move forward by one cart length. As can be seen in FIG. 8, a number of such cart rows may exist in a given area, and any number of cart arrangements and cart numbers may be employed.

Figure 9:
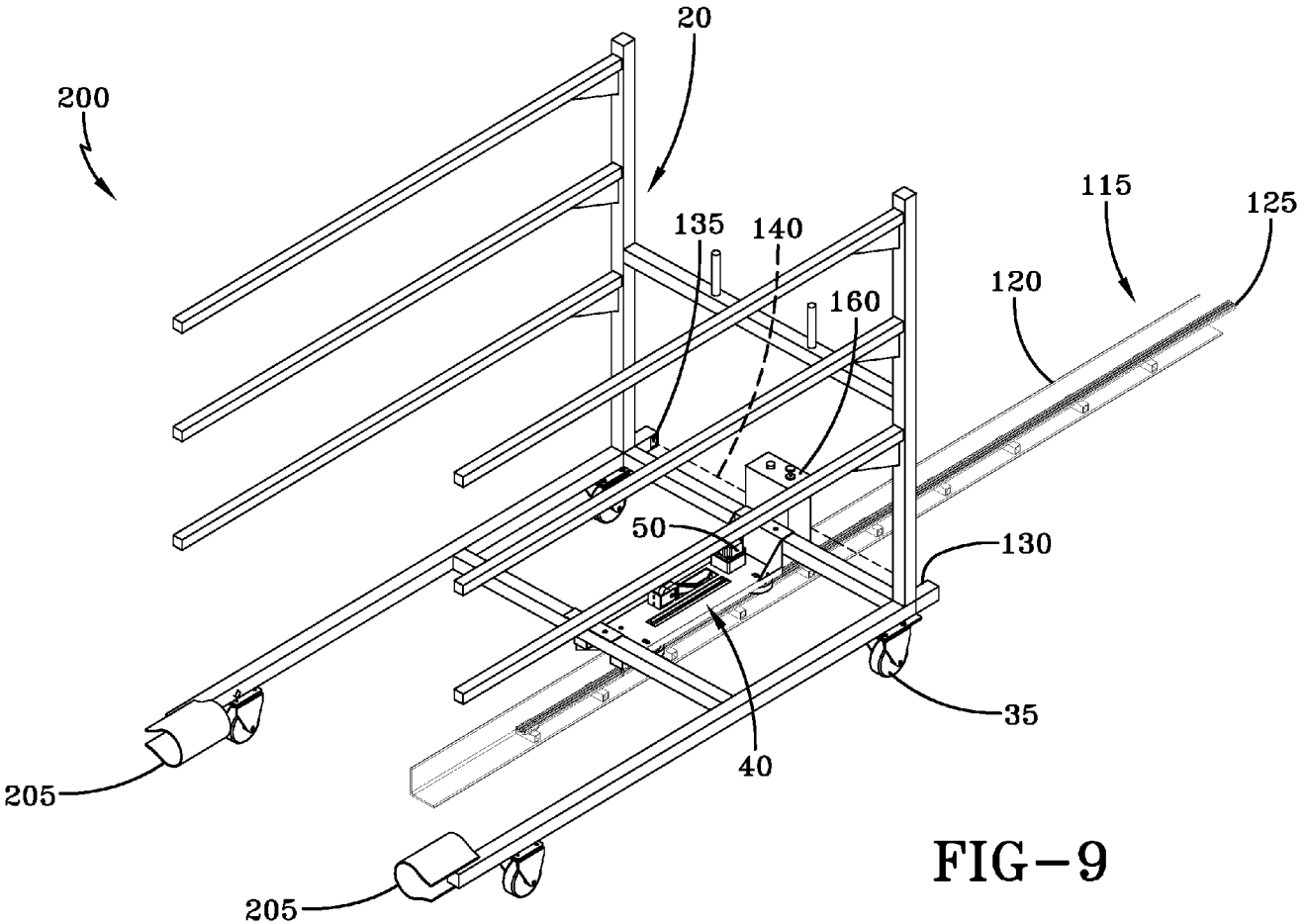
FIG. 9 a rear perspective view of another exemplary motorized cart of the present invention, the cart shown to be in powered engagement with a guide rail assembly of a system of the present invention.

An alternative embodiment of a cart 200 of the present invention is illustrated in FIG. 9. This particular cart 200 is shown to have the same framework 10, wheels 35, drive system 40, and drive controller 145 as the cart 5 shown in FIGS. 1-2. However, the orientation of this cart 200 during travel is reversed. Specifically, the rear of the previously described cart 5 is the front of this cart 200. As such, the drive system 40 acts to pull this cart 200 along the guide rail assembly 115, while the previously described cart 5 is pushed along the guide rail assembly.

To this end, it can also be observed in FIG. 9 that the cart 200 is also provided with a photo-sensor 130 that projects a photo beam 140 across the leading edge of the cart. The cart 200 is further provided with a blocking element 205 at the trailing edge of the cart. Due to the particular design of this cart 200, the blocking element 205 extends rearward from the trailing edge of the cart to interrupt the photo beam 140 before a moving trailing cart can contact a leading cart. While a pair of blocking elements 205 are shown in this particular example, it should be realized that a single blocking element may be employed as long as the blocking element is capable of interrupting the photo beam 140. Similarly, while the blocking elements 205 shown herein are designed to receive and partially surround the photo-sensor elements, alternative blocking element designs are obviously possible. The photo beam 140 and blocking elements 205 operate as described above to control stoppage of moving carts when such carts move in a line or row.

It should be noted that a cart of the present invention may be freely moved by hand or other motive force (e.g., forklift or tow motor) when not engaged with a guide rail assembly. Thus, the system of the present invention does not relegate a cart hereof to use only in an automated mode as is the case with most known motorized carts.

While certain embodiments of the present invention are described in detail above, the scope of the invention is not to be considered limited by such disclosure, and modifications are possible without departing from the spirit of the invention as evidenced by the following claims:

What is claimed is:

1. A motorized transport system, comprising:

a guide rail assembly affixed to a floor in an area of transport, said guide rail assembly defining a path along which item transport will occur, said guide rail assembly including a guide rail portion and a conductor rail portion;

at least one motorized cart for holding one or more items and transporting said one or more items along the path defined by said guide rail assembly, each motorized cart further comprising:

a frame, a plurality of wheels associated with said frame for supporting said cart in a rolling manner;

a drive system for propelling said cart along said guide rail assembly, said drive system including a drive motor, a drive wheel assembly for engaging said guide rail portion of said guide rail assembly, a contactor assembly at least partially suspended below said cart to contact said conductor rail portion of said guide rail assembly, a drive controller for controlling operation of said motor and movement of said cart, and a sensor located along a leading edge of said cart, said drive controller in communication with said drive motor and said sensor, a cart guide located beneath said cart for directing said guide rail portion of said guide rail assembly into said drive wheel assembly, and a blocking element located along a trailing edge of said cart; and a power supply electrically connected to said conductor rail portion of said guide rail assembly;

wherein, said contactor assembly is located such that, as said cart is moved into engagement with said guide rail assembly, said contactor assembly will contact said conductor rail, thereby energizing said drive motor and causing said drive wheel assembly to propel said cart along said guide rail by rotation thereof against said guide rail portion of said guide rail assembly; and wherein, said blocking element on each cart is located to interrupt a signal produced by said sensor on a trailing cart when a trailing cart approaches a leading cart in a row of carts formed along a guide rail assembly, thereby causing said drive controller of said trailing cart to de-energize the drive motor thereof, halting forward motion of said trailing cart prior to contact with said leading cart and allowing for the automated formation of a row of spaced carts.

2. The system of claim 1, wherein a plurality of guide rail assemblies are arranged in spaced rows within a given transport area.

3. The system of claim 2, further comprising a plurality of motorized carts for forming individual rows of carts along said guide rails.

4. The system of claim 1, wherein said drive wheel assembly of said at least one motorized cart includes a drive wheel driven by said drive motor and an opposed idler wheel, said drive wheel and said idler wheel having a gap therebetween of a dimension slightly less than the thickness of said guide rail portion of said guide rail assembly.

5. The system of claim 1, further comprising a guide wheel assembly on said at least one motorized cart, said guide wheel assembly including a pair of opposed and spaced apart idler wheels located to engage said guide rail portion of said guide rail assembly, said guide wheel assembly located to lead said drive wheel assembly.

6. The system of claim 1, wherein said contactor assembly of said at least one motorized cart includes a pair of contactor arms, each one of which is provided with a conductor element for providing conductive contact with a respective portion of said conductor rail of said guide rail assembly.

7. The system of claim 1, further comprising a remote control box associated with said at least one motorized cart, said remote control box allowing for manual control over the movement of said at least one motorized cart.

8. The system of claim 7, wherein said remote control box includes separate actuators for stopping and for reversing the direction of cart travel.

9. The system of claim 1, wherein said cart drive controller includes a motor control circuit board and a control relay that interact with said sensor to de-energize said drive motor when a signal produced by said sensor is interrupted.

10. The system of claim 1, wherein said sensor is a photo sensor and associated reflector that cooperate to produce a photo beam across a leading edge of said at least one motorized cart.

11. The system of claim 1, wherein said conductor rail portion of said guide rail assembly is terminated prior to said conductor guide rail portion of said guide rail assembly, and at a location of desired cart stoppage.

12. A motorized part transport system, comprising:

a plurality of guide rail assemblies affixed to a floor in an area of part transport, each guide rail assembly including a guide rail portion and a conductor rail portion, each guide rail assembly defining a path along which item transport will occur, said guide rail assemblies arranged in a plurality of spaced rows;

a plurality of motorized carts for holding one or more parts and transporting said one or more parts along the rows defined by said guide rail assemblies, each motorized cart further comprising:

a frame, a plurality of wheels associated with said frame for supporting said cart in a rolling manner;

a drive system for propelling said cart along said guide rail assembly, said drive system including a drive motor, a drive wheel assembly for frictionally engaging said guide rail portion of said guide rail assembly, a drive controller for controlling operation of said motor and movement of said cart, a contactor assembly having a pair of contactor arms at least partially suspended below said cart, each contactor arm provided with a conductor element for providing conductive contact with a respective portion of said conductor rail of said guide rail assembly and for transferring electrical energy from said conductor rail to said drive controller and said drive motor, and a sensor located along a leading edge of said cart, said sensor in communication with said drive controller and said drive motor, a cart guide located beneath said cart for directing said guide rail portion of said guide rail assembly into said drive wheel assembly, and a blocking element located along a trailing edge of said cart; and a power supply electrically connected to said conductor rail portion of said guide rail assembly;

wherein, said conductor assembly is located such that, as said cart is moved into engagement with said guide rail assembly, said contactor arms of said contactor assembly will contact said conductor rail, thereby energizing said drive controller and said drive motor and causing said drive wheel assembly to propel said cart along said guide rail by frictional rotation thereof against said guide rail portion of said guide rail assembly; and wherein, said blocking element on each cart is located to interrupt a signal produced by said sensor on a trailing cart when a trailing cart approaches a leading cart in a row of carts formed along a guide rail assembly, thereby causing said drive controller of said trailing cart to de-energize the drive motor thereof, halting forward motion of said trailing cart prior to contact with said leading cart and allowing for the automated formation of a row of spaced carts.

13. The system of claim 12, further comprising a guide wheel assembly on each motorized cart, said guide wheel assembly including a pair of opposed and spaced apart idler wheels located to engage said guide rail portion of said guide rail assembly, said guide wheel assembly located to lead said drive wheel assembly.

14. The system of claim 12, wherein said cart drive controller includes a motor control circuit board and a control relay that interact with said sensor to de-energize said drive motor when a signal produced by said sensor is interrupted.

15. The system of claim 12, wherein said sensor is a photo sensor and associated reflector that cooperate to produce a photo beam across a leading edge of each motorized cart.

16. The system of claim 12, wherein said conductor rail portion of said guide rail assembly is terminated prior to said guide rail portion of said guide rail assembly, and at a location of desired cart stoppage.

17. A semi-automated method of arranging part transport carts into a staged row, comprising:

affixing a guide rail assembly to a floor in an area of part transport, said guide rail assembly defining a length and direction for said row along which said part transport carts will be arranged, said guide rail assembly including a guide rail portion and a conductor rail portion;

providing a plurality of motorized part transport carts for holding one or more parts and transporting said one or more parts along the path defined by said guide rail assembly, each motorized cart further comprising:

a frame, a plurality of wheels associated with said frame for supporting said cart in a rolling manner;

a drive system for propelling said cart along said guide rail assembly, said drive system including a drive motor, a drive wheel assembly for engaging said guide rail portion of said guide rail assembly, a contactor assembly at least partially suspended below said cart to contact said conductor rail portion of said guide rail assembly, a drive controller for controlling operation of said motor and movement of said cart, and a sensor located along a leading edge of said cart, said drive controller in communication with said drive motor and said sensor, and a blocking element located along a trailing edge of said cart;

connecting a power supply to said conductor rail portion of said guide rail assembly;

moving a lead cart into engagement with said guide rail assembly at an entrance end of said row until said contactor assembly thereof contacts said conductor rail, thereby energizing said drive motor and causing said drive wheel assembly to propel said cart along said guide rail until said conductor assembly reaches a conductor rail termination point;

moving trailing carts into engagement with said guide rail assembly at said entrance end of said row in a like manner, whereby each trailing cart will be propelled along said guide rail assembly toward a forward cart until said blocking element on said forward cart interrupts a signal produced by said sensor on said trailing cart, thereby causing said drive controller of said trailing cart to de-energize the drive motor thereof, halting forward motion of said trailing cart prior to contact with said forward cart and allowing for the automated formation of a row of spaced carts; and periodically removing the lead cart from said row and from said guide rail assembly, whereafter the remaining carts in said row will automatically move forward by approximately one cart length and stop, producing a new lead cart while maintaining proper cart spacing.

18. The method of claim 17, wherein a plurality of guide rail assemblies are arranged in spaced rows within a given part transport area.

19. The method of claim 18, further comprising introducing a plurality of carts into one or more of said spaced rows so as to form multiple individual rows of carts.

* * * * *

UNITED STATES PATENT AND TRADEMARK OFFICE

CERTIFICATE OF CORRECTION

PATENT NO. : 8,291,829 B1
APPLICATION NO. : 12/750343
DATED : October 23, 2012
INVENTOR(S) : Dunlavy et al.

It is certified that error appears in the above-identified patent and that said Letters Patent is hereby corrected as shown below:

In column 9, line 50, please delete "conductor"

Signed and Sealed this
Twenty-ninth Day of January, 2013

David J. Kappos

David J. Kappos
*Director of the United States Patent and Trademark Office*